United States Patent [19]

Tsoi

[11] Patent Number: 5,063,364

[45] Date of Patent: Nov. 5, 1991

[54] C-, T- AND S-SWITCHES THAT ARE MECHANICALLY OPERATED BY A ROTARY ACTUATOR

[75] Inventor: Paul Y. Tsoi, Waterloo, Canada

[73] Assignee: Com Dev Ltd., Cambridge, Canada

[21] Appl. No.: 517,686

[22] Filed: May 2, 1990

[30]

Foreign Application Priority Data

Apr. 12, 1990 [CA] Canada ..... 2014584

[51] Int. Cl.[5] ..... H01P 1/12

[52] U.S. Cl. ..... 333/107; 200/504; 200/568

[58] Field of Search ..... 333/105–107; 335/4, 5, 73; 200/16 A, 504, 568, 573

[56] References Cited

U.S. PATENT DOCUMENTS 2,997,669 8/1961 Charles ..... 333/107

FOREIGN PATENT DOCUMENTS 158836 12/1979 Japan ..... 333/107

*Primary Examiner*—Paul Gensler

*Attorney, Agent, or Firm*—Daryl W. Schnurr

[57] ABSTRACT

A microwave C-, T- or S-switch has an actuator of circular shape that is rotated by a suitable motor. Each conductor path of the switch contains a connector having two positions, one position connecting the conductor path and a second position interrupting the conductor path. The conductor paths and connectors are enclosed within a housing and a pin is mounted on each connector and extends outside of the housing through a suitable opening. Each pin is spring-mounted so that the conductor path is connected when the pin is depressed and interrupted when the pin is released. The actuator is shaped and mounted to override the pins, the actuator containing one or more ridges and one or more indentations. When a ridge overrides a pin, the pin is depressed and the conductor path is connected. When an indentation overrides a pin, the pin is released and the conductor path is interrupted. By properly arranging the size and location of ridges and indentations on the actuator, the conductor paths can be connected or interrupted simply by rotating the actuator through two or more positions. The switch achieves mass and volume savings over previous switches. Also, the switch is simple and relatively inexpensive to manufacture.

14 Claims, 10 Drawing Sheets

PRIOR ART

PRIOR ART

C-, T- AND S-SWITCHES THAT ARE MECHANICALLY OPERATED BY A ROTARY ACTUATOR

BACKGROUND OF THE INVENTION

1. Field of the Invention

This invention relates to a microwave switch and, in particular, to a mechanically-operated transfer switch that is an S-switch, a C-switch, a T-switch or the like.

2. Description of the Prior Art

Transfer switches such as C-switches, S-switches or T-switches are known and are widely used in the space communications industry. For example, a communications satellite will contain numerous coaxial C-switches, S-switches or T-switches. Previous switches have a much larger mass and a much larger volume than switches of the present invention. Further, previous switches are more complex and expensive to manufacture and some previous switches have a relatively large number of moving parts making them more susceptible to failure. The switch of the present application is an improvement over the switch described in U.S. Pat. No. 4,851,801, entitled "Microwave C-switches and S-switches", naming Klaus G. Engel as inventor and being issued on July 25th, 1989.

Mass and volume are always critical parameters for space applications. Any savings in mass and volume are readily converted to cost savings, or higher communications capacity, or longer life for the satellite or a combination of these factors. Similarly, the reliability of space craft components is crucial to the success of the satellite as there are no means for correcting any malfunctions once the satellite is launched. When a component used in a satellite can be manufactured in a much simpler manner than previously, that can be very important as such a component is usually less susceptible to failure.

SUMMARY OF THE INVENTION

The present microwave switch has an RF cavity housing, an actuator and power means for repositioning said actuator arranged as follows:

(a) The housing has at least two conductor paths interconnecting at least three ports. The housing also contains at least two pins, the pins each having a separate connector thereon. One connector is located in each conductor path. Each connector has two positions that are linearly displaced from one another;

(b) The connector connects the conductor path in one position and interrupts the conductor path in another position;

(c) The housing has one opening therein for each connector. Each opening is large enough for a pin to be spring-mounted therein. Each pin is spring-mounted and has one end which is attached to that connector that is located immediately adjacent to that opening. The pin has another end being a free end. The free end is located outside of said housing when said pin is released, said spring-mounting tending to force said free end of said pin away from said housing. Each pin has two distinct positions, a depressed position and a released position;

(d) The actuator is a rotary cam mounted outside said housing and connected to said power means so that said power means can rotate said cam to at least two predetermined positions. The cam has at least one ridge and at least one indentation located thereon. The at least one ridge and the at least one indentation are located so that when a ridge overrides a pin, said pin is depressed and when an indentation overrides a pin, said pin is released. The at least one ridge and the at least one indentation override said pins as said cam rotates; The at least one ridge and the at least one indentation are coordinated with the power means so that appropriate conductor paths are connected and interrupted substantially at the same time. The cam, the power means, the springs, the pins and the connectors are the only movable components of the switch.

DESCRIPTION OF A PREFERRED EMBODIMENT

Figure 1A:
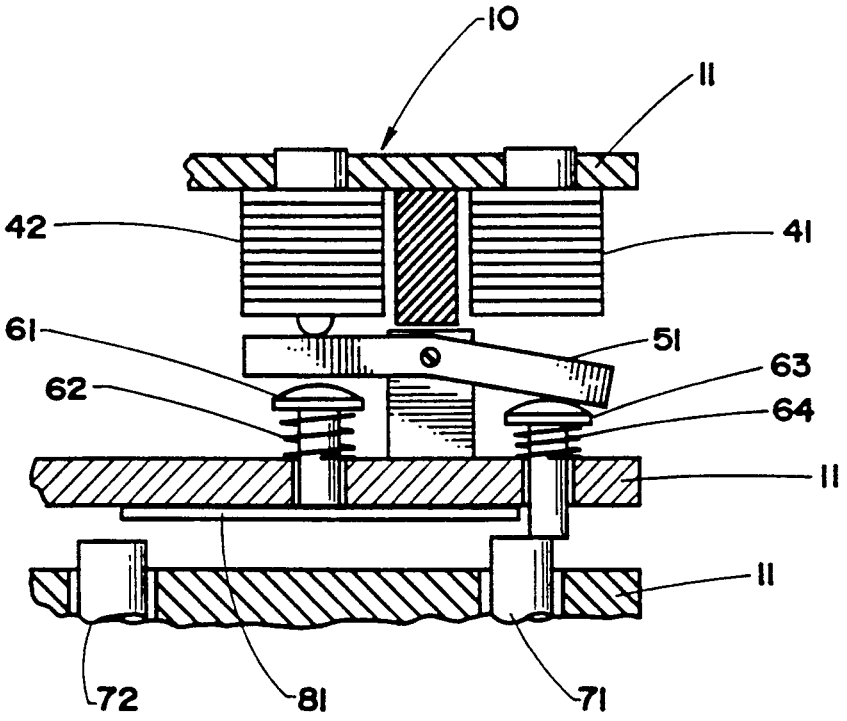
FIGURE 1a PRIOR ART
FIG. 1*a* is a sectional side view of a prior art S-switch having an electromagnetic and clapper arrangement for each switch connecting path that is shown in a first position.
Figure 1B:
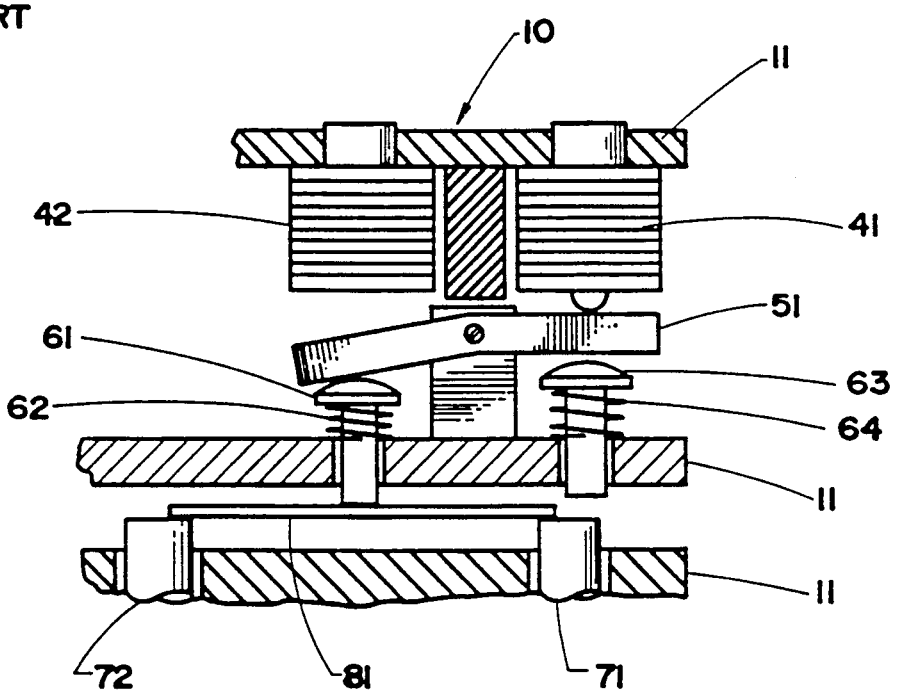
FIG. 1*b* is a sectional side view of the prior art S-switch of FIG. 1*a* shown in a second position.

In FIGS. 1*a* and 1*b*, there is shown a side view of a prior art coaxial C-switch 10 having electromagnets 41, 42 mounted with a housing 11 (only part of which is shown). The switch is shown in a first position in FIG. 1*a* where the supply of electrical current to the electromagnet 42 has caused a linear movement with a corresponding force to displace rocker arm 51 about its pivot point causing circular rod 63 to move in a linear direction and make contact with conductor 71. The supply of an electrical current to electromagnet 41 instead of the electromagnet 42 causes a further linear movement that displaces rocker arm 51 to a second position as shown in FIG. 1*b*. The displacement of the rocker arm 51 in turn causes the downward vertical displacement of circular rod 61 that further causes the linear displacement of reed 81, creating an electrical connection between conductors 71 and 72. Simultaneously with this further movement of rocker arm 51, the previously compressed return spring 64 shown in FIG. 1*a* will create an opposing mechanical force that causes rod 63 to displace vertically upward in the said FIG. 1*b* out of contact with conductor 71. It can readily be seen that the electromechanical switch shown in FIGS. 1*a* and 1*b* has a number of complex moving parts to cause the switch to operate between one input port and two output ports. The switch 10 can continuously be operated to return to the first position shown in FIG. 1*a* from the second position shown in FIG. 1*b*, return spring 62 causing rod 61 to move reed 81 out of contact with conductors 71, 72. To achieve the operation of the switch 10 requires two assemblies as shown in FIGS. 1*a* and 1*b* with a duplication of parts. Obviously, the S-switch would be larger in volume and mass than the C-switch. The opposing return spring which has a compressed force associated with the switch operation is usually some fraction of the actuator thrust. This can leave the switch vulnerable to contact sticking and hence degrade the reliability of the switch.

Figure 2A:
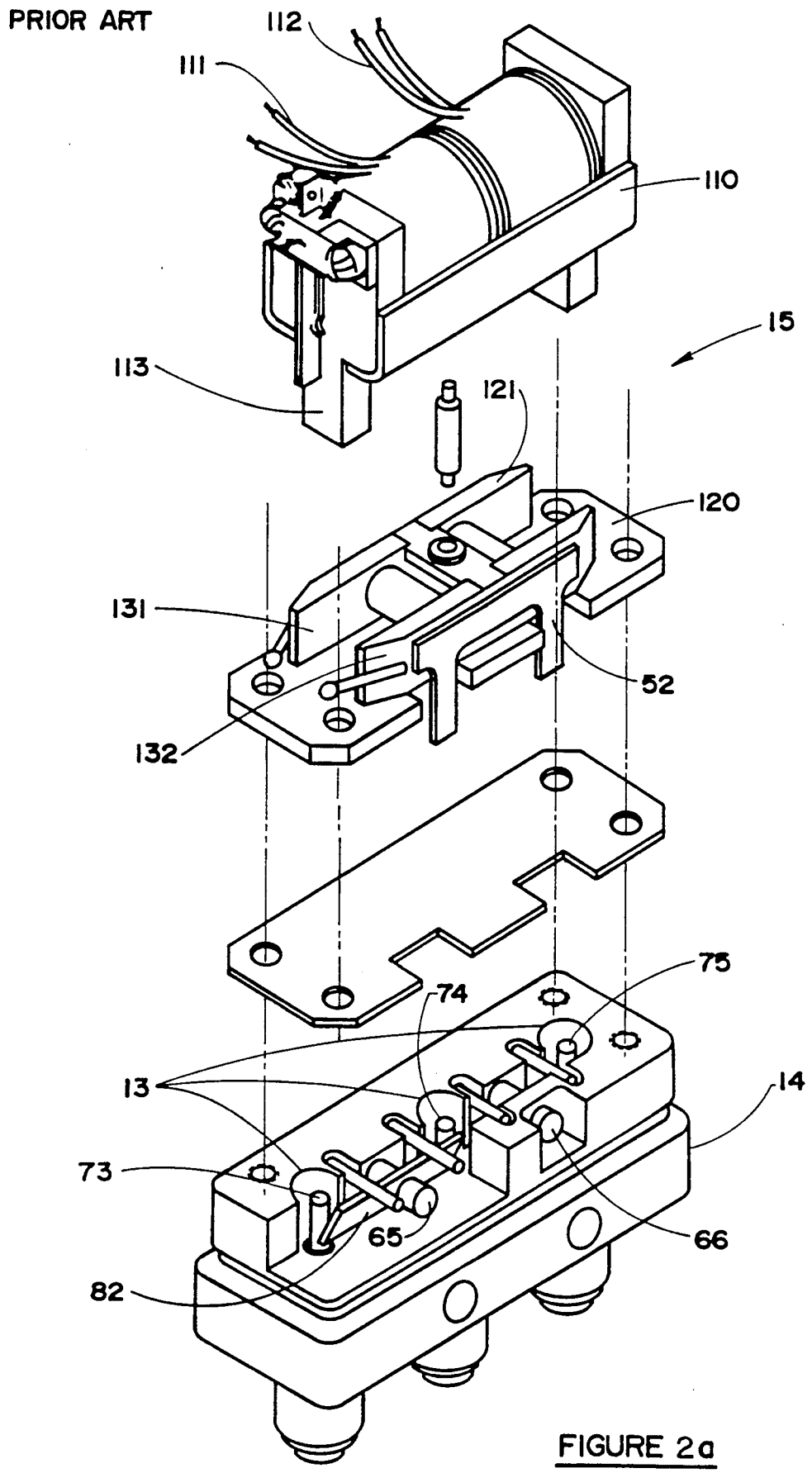
FIG. 2*a* is an exploded perspective view of a prior art electromagnetic and mechanical lever mechanism type of arrangement for the connecting and disconnecting between two adjacent paths.
Figure 2B:
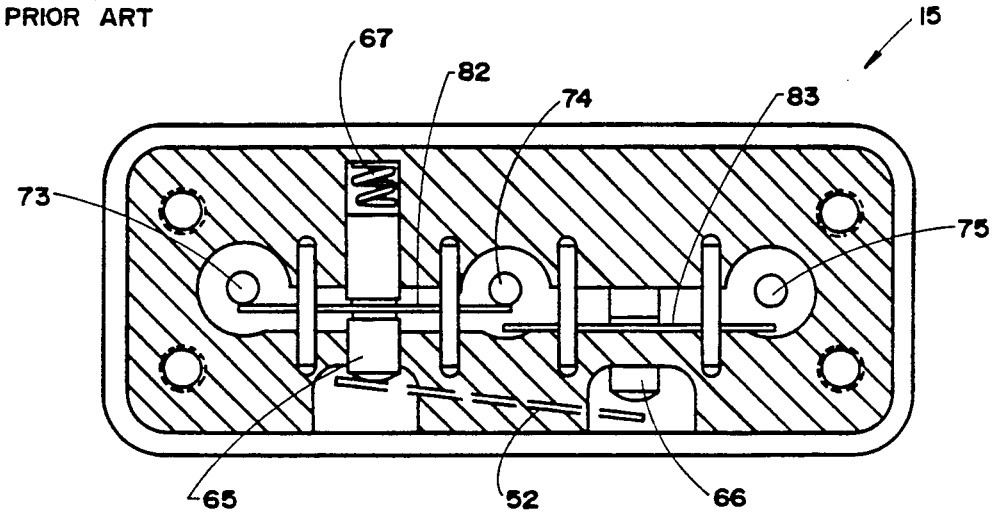
FIG. 2*b* is a sectional top view of the prior art switch shown in FIG. 2*a;*
Figure 2C:
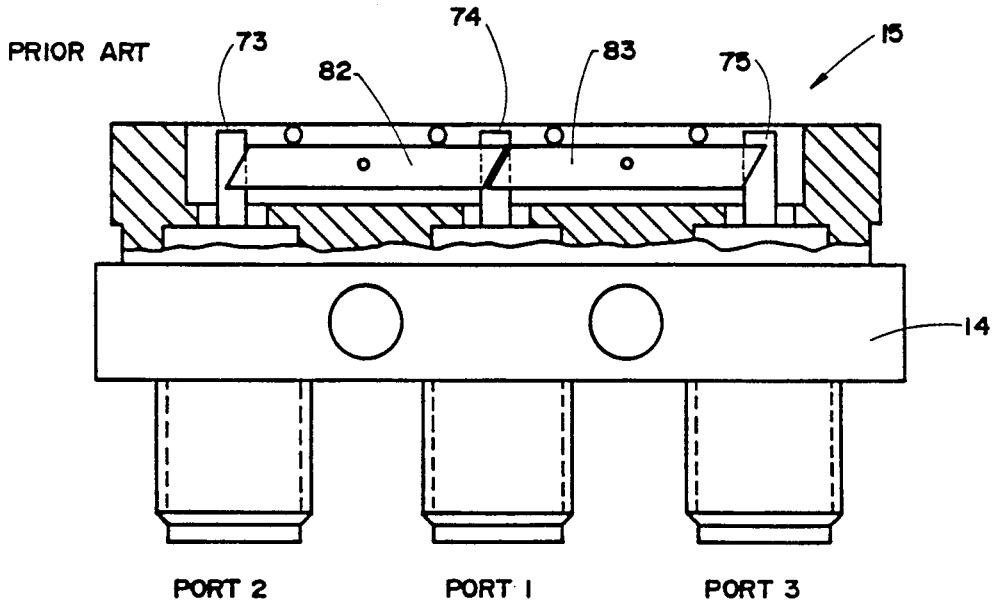
FIG. 2*c* is a partial sectional side view of the prior art switch shown in FIG. 2*a*.

In FIGS. 2*a*, 2*b* and 2*c*, there is shown a prior art electromagnetic switch 15 with a mechanical lever actuated mechanism. The switch 15 has a dual polarity electromagnetic coil 111, 112 configuration, together with an RF cavity assembly 13 housed within a primary housing 14. As the switch 15 is a prior art switch, only those components relevant to the operation of the switch are specifically described. To operate the switch actuator, an electrical current is applied to either winding 111 or 112. The application of such an electrical field will cause a magnetic field to attract the opposite field polarity of a magnetized clapper arm 121. The switch can be activated by applying a current to coil winding 111 that attracts a clapper assembly pole 132 causing clapper arm 121 to rotate in a clockwise direction until the pole 132 comes to rest at actuator assembly stop 113. In FIG. 2*b*, it is shown that the corresponding rotational movement of rocker arm 52 will cause a linear movement of plunger 65 that causes reed 82 to connect with the connector contacts 73, 74, thereby connecting port 1 and port 2. Conversely, when the electrical coil 112 is energized by an electrical current, the clapper magnetic pole 131 will be attracted to the reversed polarity of the magnetic stop 113 that causes the clapper assembly to rotate counterclockwise. This rotational movement in turn causes the rocker arm 52 to apply a linear movement to plunger 66 that moves reed 83 to make contact with connector contacts 74, 75, thereby connecting port 1 and port 3. The expansion of return spring 67 from a first position shown in FIG. 2*b* will cause the reed 82 to disconnect from connector contacts 73, 74, thus causing port 2 to be disconnected from port 1. Typical electromagnetic generated coaxial switches are usually of lower mass than solenoid type switches. This type of switch configuration employs a number of components to achieve a translation from the initial set of contacts to the selected set. In addition to the high part count associated with the switch 15 as shown in FIGS. 2*a*, 2*b* and 2*c*, there is a requirement for intricate tolerances and detailed machined finishes which produces an adverse effect with numerous locations of mechanical wear occurring at primary locations such as the clapper assembly, rocker arm, switch reeds and the ends of the push rods.

Figure 3:
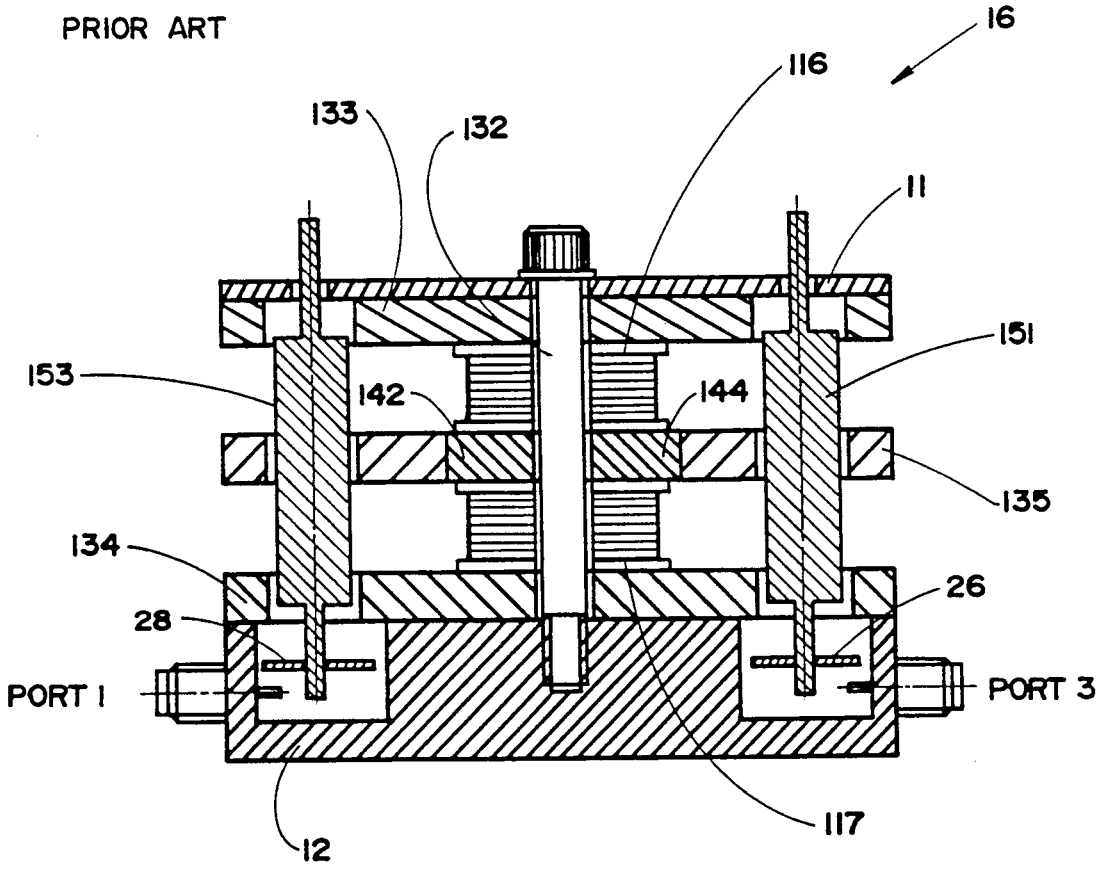
FIG. 3 is a sectional side view of a coaxial S-switch of a prior art coaxial S-switch having electromagnetic means to actuate armatures.

In FIG. 3, there is shown a sectional side view of an electromagnetic switch 16 in accordance with the present invention with the RF cavity housing 12 located within a housing 11.

Figure 4:
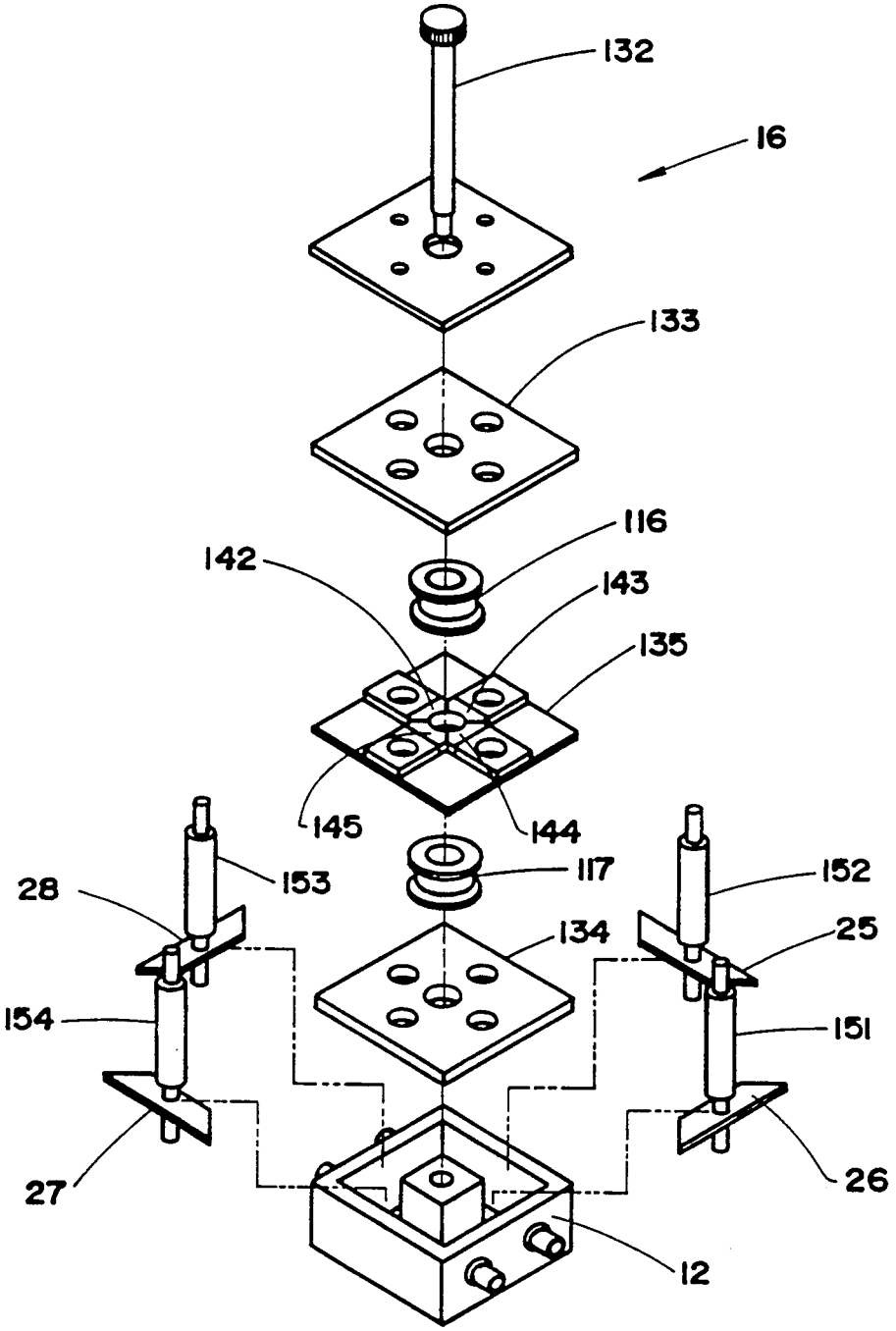
FIG. 4 is an exploded perspective view of the prior art S-switch of FIG. 3.

From FIGS. 3 and 4, it can be seen that the switch 16 has conductor paths located in the RF cavity housing 12. Four movable connectors 25, 26, 27, 28 are shown which are fastened to four armatures 151, 152, 153, 154. The connectors 25, 26, 27, 28 are each long enough to comprise one entire conductor path for the switch 16. The upper and lower magnetic returns 133, 134 are separated by a center plate 135 and upper and lower windings 116 and 117, respectively. To complete the magnetic circuit the magnetic returns, center plate 135 and upper and lower windings 116, 117 are fastened with a pin 132 that serves as a back iron to the magnetic circuit. Four permanent magnets 142, 143, 144, 145 are supported on the center plate 135, one for each of the armatures 153, 152, 151, 154 respectively. The magnets are oriented as such that opposite armatures say 152, 154 experience the same magnetic polarity. The two magnets for the two remaining armatures 151, 153 respectively are oriented with an opposite or opposing magnetic field. In other words, the armatures 152, 154 oppose the armatures 151, 153. An electrical pulse supplied to either of the coil windings 116, 117 will cause one set of opposing armatures 152, 154 to rise, thus disconnecting the attached connector from the respective conductor path in which it is located and interrupting said path. During the execution of the same electrical pulse the remaining part of armatures 151, 153 will simultaneously lower, thus causing a connection between their respective connectors and conductor paths. The coil windings can be configured to operate the switch to satisfy two principles.

The winding direction of coils 116, 117 can be utilized electrically to function in a series or parallel circuit arrangement. The advantage of an independent coil with the alternative parallel circuit will permit redundance if one coil should fail or an additional margin of the applied voltage with reference to the switching threshold applied voltage.

Figure 5:
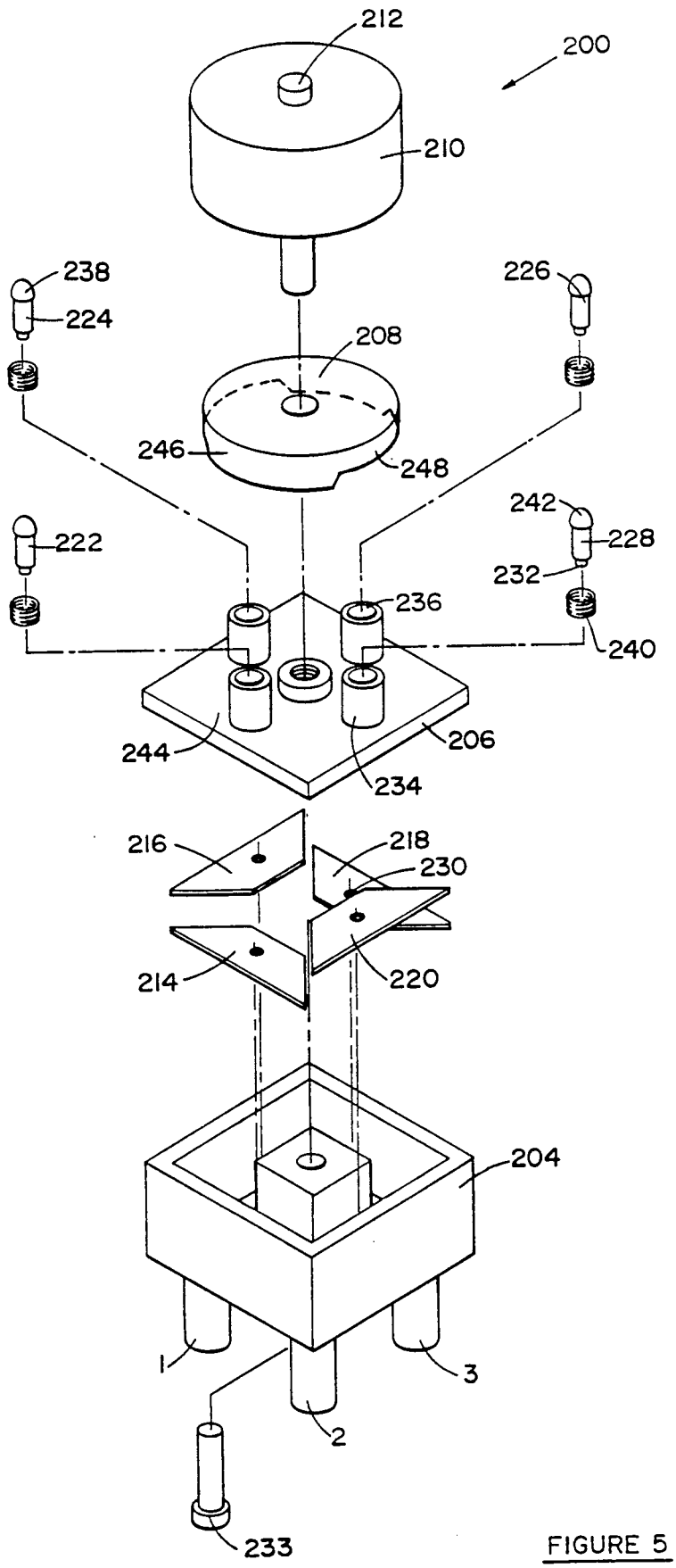
FIG. 5 is an exploded perspective view of an S-switch.

In FIG. 5, a coaxial S-switch 200 has an RF cavity housing 204 including a cover 206, an actuator 208 having a circular shape and a power means or motor 210. The motor 210 is a permanent magnet stepper motor and is connected to the actuator 208 by a shaft 212. The actuator 208 is a rotary cam. It can be seen that the switch 200 has four conductor paths located in the RF cavity housing 204. Four movable connectors or reeds 214, 216, 218, 220 are connected to pins 222, 224, 226, 228, respectively. Each of the connectors 214, 216, 218, 220 contains a hole 230 therein for receiving one end 232 of each of the pins 222, 224, 226, 228, respectively. Each hole 230 is located approximately at a longitudinal center of each of the connectors.

The housing 204 contains four ports 1, 2, 3, 4 (only three of which are shown in FIG. 5). The ports are arranged in a square configuration. The cover 206 can be affixed to the housing 204 by a threaded bolt 233. The cover 206 contains four cylindrically-shaped projections 234, each projection having an open top 236. The projections 234 are arranged relative to one another so that when the cover 206 is in place on the housing 204, one pin is located in each projection. The top 236 of each projection 234 provides a limit for the distance that the pin located in the projection can be depressed by a ridge of the cover.

The cover 206 contains one opening to receive each of the pins 222, 224, 226, 228. While an end 232 of each pin is attached to a connector, a free end 238 of each pin is located outside of said housing 204, including said cover 206. A spring 240 is located in each projection 234 between a head 242 of each pin and an outer surface 244 of the housing. The projection 234 provides retention means for the spring 240. In a released position, the free end of each pin protrudes from said housing beyond said top. Each spring 240 is compressed between said head and said outer surface and tends to force the free end 238 away from said housing 204 including said cover 206.

The actuator 208 is a rotary cam that is mounted outside of said housing and connector to the motor 210 by means of the shaft 212. The cam 208 has two ridges 246 (only one of which is shown in FIG. 5) and two indentations 248 located thereon so that when the ridges 246 override a pin, the pin is depressed and when an indentation 248 overrides a pin, the pin is released. The size of the cam 208 and the location of the ridges 246 and indentations 248 thereon is determined by the location of the pins protruding from the projections 234 of the cover 206. The ridges and indentations are coordinated with the motor so that as the cam is rotated, appropriate conductor paths of the switch are connected and interrupted substantially at the same time. The cam, the power means, the springs and the connectors are the only movable components of the switch 200.

Each pin has two distinct positions, a depressed position and a released position. Preferably, when a pin is in a depressed position, the conductor path, in which that pin and connector are located, is connected. Further, when a pin is in a released position, the conductor path, in which that pin is located, is interrupted.

Figure 6:
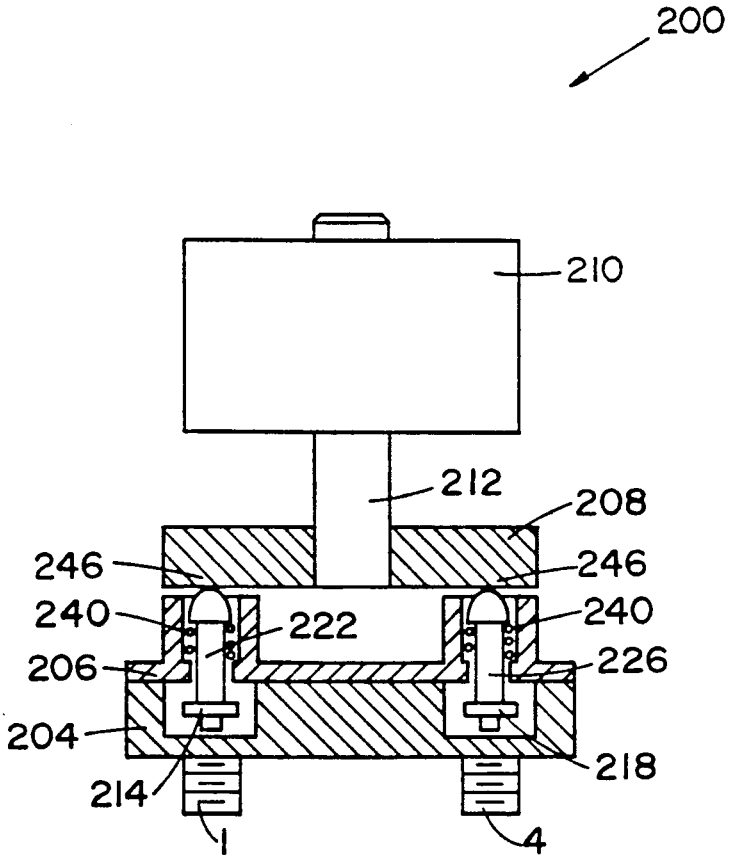
FIG. 6 is a sectional side view of an S-switch in accordance with the present invention showing two pins in a depressed position.
Figure 7:
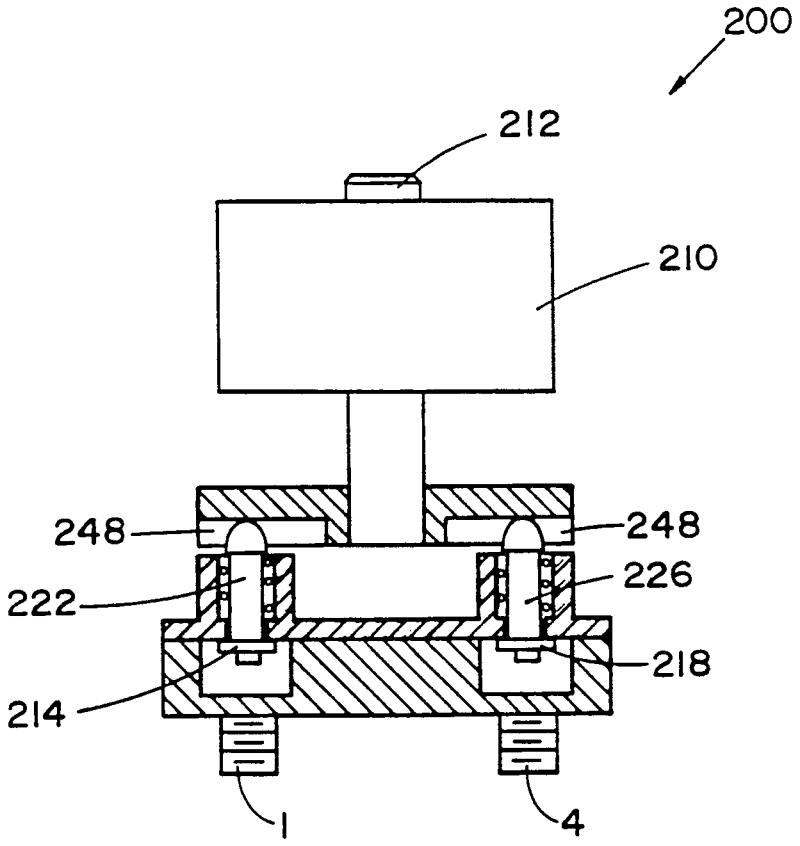
FIG. 7 is a sectional side view of the S-switch of FIG. 4 with two pins in a released position.

In FIGS. 6 and 7, the switch 200 is shown in various positions. In FIG. 6, the pins 222, 226 are both in a depressed position with the ridges 246 forcing the pins downward against the springs 240 and connecting the conductor paths in which the connectors 214, 218 are located.

In FIG. 7, the pins 222, 226 are in a released position so that the conductor paths in which the connectors 214, 218 are located, are interrupted. Since indentations 248 are located above the pins 222, 226, the springs 240 force the pins upward, thereby interrupting the conductor paths in which the connectors 214, 218 are located. The position of the pins shown in FIGS. 6 and 7 would result when the ridges 246 on the actuator 208 alternate with indentations 248. In other words, since there are four pins in the switch 200, when there are two alternating ridges 246 and two alternating indentations 248, all equally spaced from one another on the cam 208 with one indentation between each of the ridges, then every alternate pin will be depressed and pins located between the depressed pins will be in a released position. For example, when pins 222, 226 are depressed, pins 224, 228 will be released and vice-versa.

Figure 8:
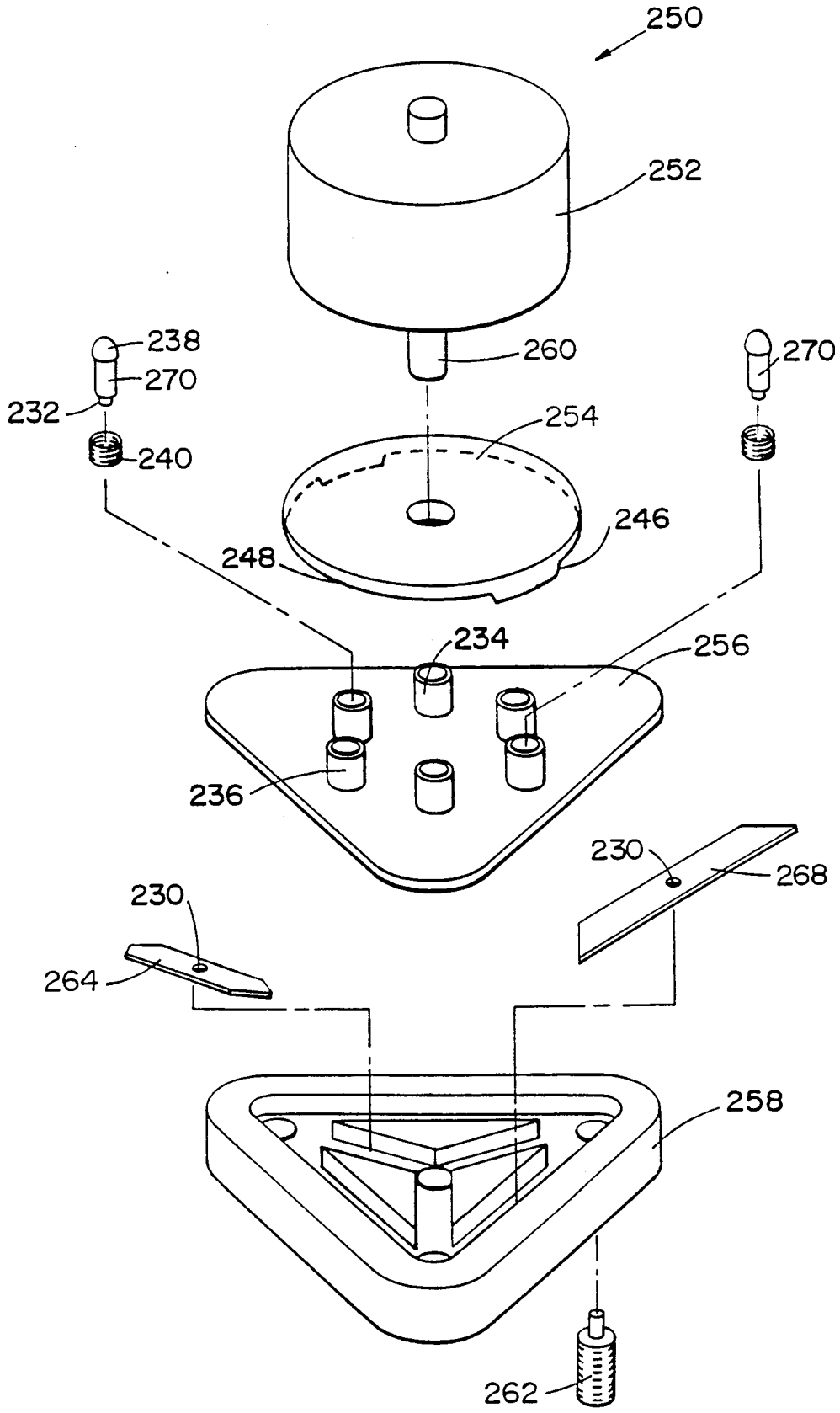
FIG. 8 is an exploded perspective view of a T-switch.

In FIG. 8, there is shown a T-switch 250 having a motor 252, an actuator 254, a cover 256 and a housing 258, said housing including said cover 256. The motor 252 has a shaft 260. As can be seen, the housing 258 has six conductor paths, three along the periphery of said housing and three radially extending from a center of said housing. The switch 250 has four ports 262, only one of which is shown in FIG. 8. The fourth port is located at a center of the housing 258. There are three short connectors 264 having holes 230 therein (only one of which is shown in FIG. 8). The short connectors 264 are designed to be placed in the radial connecting paths. There are also three long connectors 268, also containing holes 230 (only one of which is shown in FIG. 8). The long connectors 268 are designed to be located in the conductor paths along a periphery of the housing 258. As with the switch 200, the cover 256 has a plurality of cylindrically-shaped projections 234 thereon, said projections being open at a top 236.

Each of the projections 234 contains a pin 270 which is spring-mounted via a spring 240 so that a lower end 232 is located within the hole 230 while a free end 238 extends beyond the top 236 when the ends are in a released position. The cam 254 has two ridges located thereon, together with two large indentations between said ridges. The indentations extend circumferentially on said cam a greater distance than a circumferential distance of each ridge. The switch 250 has three distinct positions. When the cam is in a first position, the two ridges 246 will depress a first long connector 268 and a first short connector 264, while the remaining connectors will be in a released position. The connection will therefore be completed in the conductor paths in which the connectors are depressed and interrupted in those conductor paths in which the connectors are released. In a second position, a second long connector 268 will be depressed and a second short connector normal thereto will also be depressed, the remaining connectors being released. Similarly, in a third position, a third long connector 268 will be depressed and a third short connector normal thereto will be depressed, with the remaining connectors being released.

Figure 9:
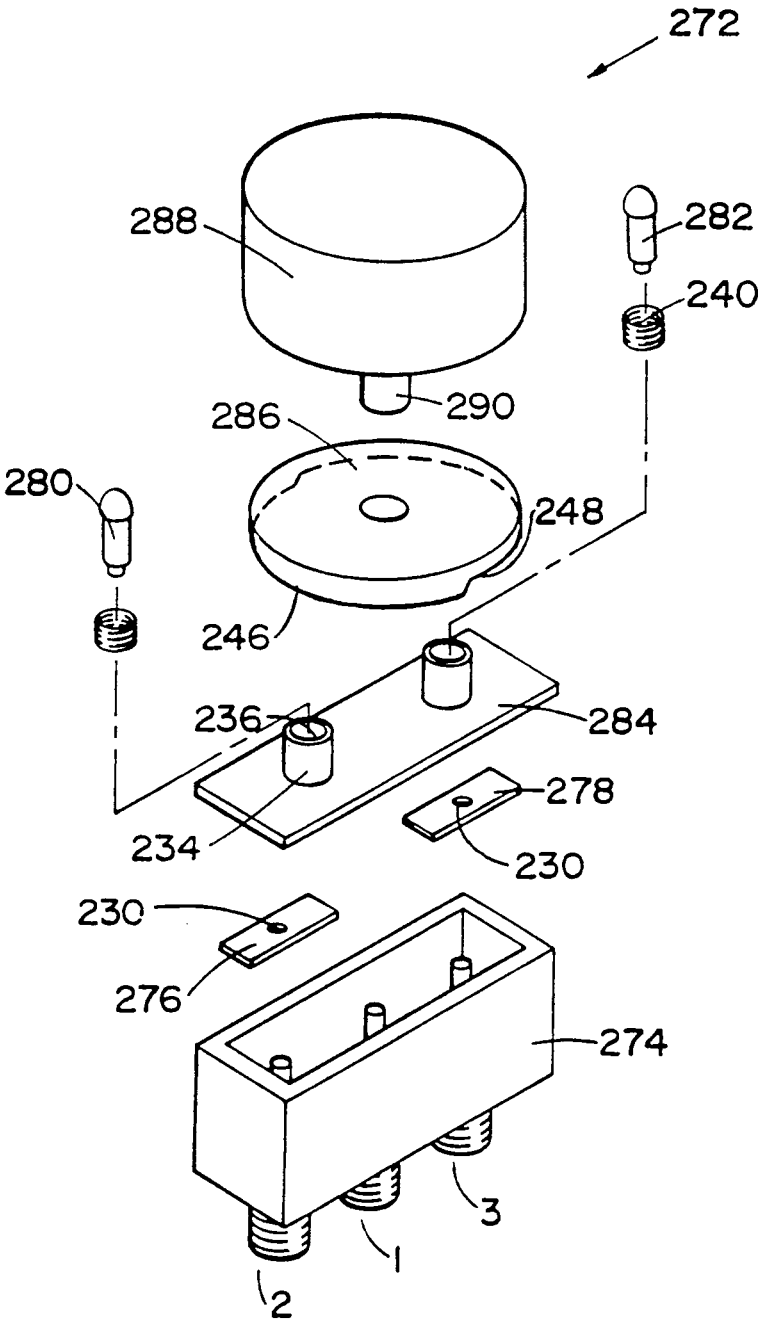
FIG. 9 is an exploded perspective view of a C-switch.

In FIG. 9, there is shown a C-switch 272 with an RF cavity housing 274 having three ports 1, 2, 3. Within the housing 274, there are located two connectors 276, 278. The connectors 276, 278 each contain an opening 230 to receive a free end of pins 280, 282 respectively. The housing 274 has a cover 284 with cylindrically-shaped projections 234 having open tops 236. The pins and springs are sized to be located within the projections 234. A cam 286 has one ridge 246 and one indentation 248 thereon. The cam 286 is connected to a shaft 290 of a step-motor 288. When the cam is rotated so that the ridge overrides the pin 280, the indentation will simultaneously be located above the pin 282. In this position of the cam 286, the pin 280 will be depressed, thereby connecting the ports 1 and 2 and the pin 282 will be released so that the ports 1 and 3 will not be connected. Similarly, when the cam is rotated so that the ridge 246 overrides the pin 282, the indentation 284 will be located above the pin 280. In this position of the cam, the pin 282 will be depressed, thereby connecting ports 1 and 3 and the pin 280 will be released resulting in the ports 1, 2 being disconnected. In each of said positions, the connectors on the two pins that are depressed are preferably normal to one another.

Switches of the present invention can be designed so that a particular conductor path is connected simultaneously with another conductor path being interrupted. The switching time is the time between the interruption of one set of conductor paths in a switch and the connection of another set of conductor paths. A switch can be designed so that the connection/interruption sequence can be altered to best suit the needs of specific circumstances. For example, by increasing the rotational length of the ridges of the cam, the conductor paths of the switch that are being connected are connected slightly before the conductor paths that are being interrupted are in fact interrupted. Since the switches of the present invention have a minimum of moving parts, the switch can be manufactured efficiently and less expensively than previously switches.

Also, the switch has a high reliability as the connectors, which include the pins, the springs and the actuator are the only moving parts.

It has been found that when a T-switch or C-switch is made in accordance with the present invention, the switch can be made small enough to have a cross-sectional area normal to the axis of movement of the pins of substantially 0.95 square inches. Since the pins, actuator and connectors can be made of light-weight materials, the motor can be made smaller and large mass savings can be achieved. The connectors can be made of various materials that will be suitable, including without limitation, a conducting plastic material. Numerous variations within the scope of the attached claims will readily be apparent to those skilled in the art.

What I claim as my invention is:

1. A microwave switch comprising an RF cavity housing, an actuator and power means for repositioning said actuator arranged as follows:

(a) said housing having at least two conductor paths interconnecting at least three ports, said housing also containing at least two pins, each pin having a separate connector thereon, one connector being located in each conductor path, each connector having two positions that are linearly displaced from one another;

(b) each connector connecting the conductor path in one position and interrupting the conductor path in another position;

(c) said housing having one opening therein for each pin, each opening being large enough for a pin to be spring-mounted therein, each pin being spring-mounted and having one end which is attached to that connector that is located immediately adjacent to that opening, said pin having another end being a free end, said free end being located outside of said housing when said pin is released, said spring-mounting tending to force said free end of said pin away from said housing, each pin having two distinct positions, a depressed position and a released position;

(d) said actuator being a rotary cam mounted outside said housing and connected to said power means so that said power means can rotate said cam to at least two predetermined positions, said cam having at least one ridge and at least one indentation located thereon, said at least one ridge and said at least one indentation being located so that when a ridge overrides a pin, said pin being depressed and when an indentation overrides a pin, said pin is released, said ridge and said indentation overriding said pins as said cam rotates;

said at least one ridge and said at least one indentation being co-ordinated with said power means so that appropriate conductor paths are connected and interrupted substantially at the same time, the cam, the power means, the springs, the pins and the connectors being the only movable components of the switch.

2. A microwave switch as claimed in claim 1 wherein a conductor path is connected by a connector when the connector is in a depressed position and interrupted when the connector is in a released position.

3. A microwave switch as claimed in claim 2 wherein the ridges and indentations on the cam are located relative to one another so that appropriate conductor paths are connected and interrupted simultaneously.

4. A microwave switch as claimed in claim 2 wherein the ridges and indentations are located relative to one another so that the conductor paths that are being connected are connected slightly before the conductor paths that are being interrupted are in fact interrupted.

5. A microwave switch as claimed in claim 2 wherein the cam has a circular shape and the power means is a motor.

6. A microwave switch as claimed in claim 2 wherein the free end of each pin has a rounded head thereon and each pin is spring-mounted by a spring that is compressed between said head and an outer surface of said housing.

7. A microwave switch as claimed in claim 6 wherein each opening in said housing is surrounded by a cylindrically-shaped projection with an open top, said top providing a limit for the distance that the pin can be depressed by a ridge of the cam and also providing retention means for said spring, in a released position said free end of said pin protruding from said housing beyond said top.

8. A microwave switch as claimed in any one of claims 2, 3 or 4 wherein the switch is an S-switch and the housing contains four conductor paths, four ports, four pins, four openings, and four connectors, there being one cylindrically-shaped projection surrounding each opening, said connectors and said pins being arranged in a generally square configuration with each pin being connected to a separate connector, said cam containing two ridges and two indentations arranged alternately in the same generally square configuration as said pins, said cam having two distinct positions, in a first position, a first and third pin being depressed and a second and fourth pin being released, and in a second position, a second and fourth pin being depressed and a first and third pin being released.

9. A microwave switch as claimed in any one of claims 2, 3 or 4 wherein the switch is a T-switch and the housing contains six conductor paths, four ports, six pins and six connectors, each pin being connected to a separate connector, one connector connecting ports one and two, one connector connecting ports two and three, one connector connecting ports one and three, one connector connecting ports one and four, one connector connecting ports two and four and one connector connecting ports three and four, said cam containing two ridges and two indentations, each indentation extending circumferentially on said cam a greater distance than a circumferential distance of said ridges and indentations being arranged to correspond to the location of said pins so that said cam has at least three distinct positions, in each position, two pins being depressed and the remaining pins being released.

10. A microwave switch as claimed in any one of claims 2, 3 or 4 wherein the switch is a T-switch and the housing contains six conductor paths, four ports, six pins and six connectors, each pin being connected to a separate connector, one connector connecting ports one and two, one connector connecting ports two and three, one connector connecting ports one and three, one connector connecting ports one and four, one connector connecting ports three and four, said fourth port being located at a center of said housing, said cam containing two ridges and two indentations, each indentation extending circumferentially on said cam a greater distance than a circumferential distance of each ridge, said ridges and indentations being arranged to correspond with the location of the pins, said cam having three positions, a first position where pins one and four are depressed and the remaining pins are released, a second position where pins two and five are depressed and the remaining pins are released and a third position where pins, three and six are depressed and the remaining pins are released, in each of said positions, the connectors on the pins that are depressed being normal to one another.

11. A microwave switch as claimed in any one of claims 2, 3 or 4 wherein the switch is selected from the group of a C-switch and a T-switch and has a cross-sectional area normal to an axis of movement of the pins of substantially 0.95 square inches.

12. A microwave switch as claimed in any one of claims 2, 3 or 4 wherein the switch is a C-switch and the housing contains two conductor paths, three ports, two pins and two connectors, each pin being connected to a separate connector, one connector connecting ports one and two and the other connector connecting ports one and three, said cam containing one ridge and one indentation that are arranged to correspond to the location of said pins, said cam having two distinct positions, in a first position, said first pin being depressed and said second pin being released and in a second position, said second pin being depressed and said first pin being released.

13. A microwave switch as claimed in any one of claims 2, 3 or 4 wherein the conductor path is connected when the pin is depressed and interrupted when a pin is released.

14. A microwave switch as claimed in any one of claims 2, 3 or 4 wherein each pin is located approximately at a longitudinal center of each connector.

* * * * *